US007441727B2

(12) United States Patent
Sharkey et al.

(10) Patent No.: US 7,441,727 B2
(45) Date of Patent: Oct. 28, 2008

(54) HIGHWAY-RAIL GRADE CROSSING CONTROLLER WITH OUT OF SERVICE MODE

(75) Inventors: John T. Sharkey, Elgin, IL (US); Richard Bamfield, Upland, CA (US)

(73) Assignee: Safetran Systems Corporation, Louisville, KY (US)

( * ) Notice: Subject to any disclaimer, the term of this patent is extended or adjusted under 35 U.S.C. 154(b) by 272 days.

(21) Appl. No.: 11/132,047

(22) Filed: May 18, 2005

(65) Prior Publication Data

US 2006/0261219 A1 Nov. 23, 2006

(51) Int. Cl.
*B61L 1/00* (2006.01)

(52) U.S. Cl. ..... 246/125; 246/114 R; 246/122 R; 246/219; 246/473.1; 307/141; 307/141.4

(58) Field of Classification Search ..... 246/3, 246/114 R, 122 R, 123, 125, 473.1, 473 R, 246/127, 218, 219, 114 A, 111, 112, 113; 340/309.8, 309.16, 309.9, 527; 307/141, 307/141.4

See application file for complete search history.

(56) References Cited

U.S. PATENT DOCUMENTS 6,853,890 B1 * 2/2005 Horst et al. ..... 701/20
6,985,071 B1 * 1/2006 Tanaka ..... 340/309.16
2003/0051631 A1 * 3/2003 Ring ..... 105/1.5
2003/0144772 A1 * 7/2003 Proulx ..... 701/19
2003/0178534 A1 * 9/2003 Peltz et al. ..... 246/187 A

OTHER PUBLICATIONS

Invensys—Application Guidelines, Microprocessor Based Grade Crossing Predictor Model 3000 Family.
Safetran Systems Corporation, Instruction & Installation, Solid-State Crossing Controller III Plus (SSCC 111 Plus) 91190, 91195, Apr. 2004, Document No. SIG-00-02-03, Version D.
Safetran Systems Corporation, Instructions & Installation, Microprocessor Based Grade Crossing Predictor Mode; 3000 Family, Apr. 2002, Document No. SIG-00-00-02, Version B.
National Transportation Safety Board, Washington, D.C., Railroad Accident Report, Collision of Amtrak Train 304-26 With A Highway Vehicle At a Highway-Rail, no date.
Grade Crossing Mclean, Illinois, Sep. 26, 1999, PB2001-916303 NTSB/ RAR-01/03, pp. 1-38.

* cited by examiner

*Primary Examiner*—Mark T Le
(74) *Attorney, Agent, or Firm*—Cook Alex Ltd.

(57) ABSTRACT

An electronic controller for a highway-railroad grade crossing warning system is coupled to an approach circuit and to an island circuit and activates a warning device when a train is present in either of the approach or the island circuits. The controller has a display with touch-sensitive fields for selectively taking the approach circuit or island circuit out of service. Additional touch-sensitive fields on the display may be used for selecting the amount of time that the approach or island circuits remain out of service and for confirming that the maintainer wishes to take the these circuits out of service. Service is automatically restored upon expiration of the selected amount of time.

9 Claims, 4 Drawing Sheets

HIGHWAY-RAIL GRADE CROSSING CONTROLLER WITH OUT OF SERVICE MODE

FIELD OF THE INVENTION

The present invention relates generally to apparatus for highway-rail grade crossing warning systems. More particularly, the present invention relates to improved apparatus and methods for taking such a crossing warning system out of service.

BACKGROUND OF THE INVENTION

It is common practice in highway-railroad grade crossing warning systems for control circuitry to consist of an arrangement of electromagnetic relays operating on 12 volts DC, or electronic processor equivalent inputs and outputs (I/O) operating on the same voltage. The control circuitry, which controls flashing of the lights and, when used, operates the gates, receives its input from train detection circuit outputs. The control and train detection circuitry operate on closed circuit fail-safe design principles. An electrical interruption, such as a short circuit or open circuit in the circuitry, results in activation of the warning devices. That is, the flashing lights are activated and the gates, when used, are caused to descend.

During routine signal or track maintenance activities that activate the warning devices, or when a malfunction occurs in the train detection circuitry that activates the warning devices, maintenance personnel can simulate repair or turn off the devices by connecting an electrical jumper between an appropriate voltage source and the malfunctioning control input. The result is a deactivation of the warning devices which turns the flashing lights off and which returns the gate arms to the vertical position. This situation is referred to as an "Out of Service" mode because a train will not be detected on the affected track or tracks. Since the input to the system is falsely energized in a manner that is electrically the same as normal operation, the system cannot differentiate the false energization from the normal operation.

The industry recognizes that the placement of a jumper in the circuitry to cause one or more tracks to be placed out of service is subject to human error. At least one fatal accident has occurred due to failure to remove a jumper after completion of maintenance work. After maintenance work has been completed, the signal maintainer needs to remove the jumper wire from the grade crossing control relay and verify the operational status of the grade crossing equipment as required by established railroad procedures.

A general object of the present invention is to provide a highway-rail grade crossing controller with an improved out of service capability.

Another object of the present invention is to provide a highway-rail grade crossing controller with an out of service capability for an approach circuit, an island circuit, or both.

A further object of the present invention is to provide a highway-rail grade crossing controller with such an out of service capability that requires confirmation that the maintainer wants to take a track out of service to minimize human error.

Yet another object of the present invention is to provide a highway-rail grade crossing controller with such an out of service capability with a timer that will return an out of service track to normal operation upon expiration of selected time interval.

A still further object of the present invention is to provide a highway-rail grade crossing controller that notifies a railroad operations control center of an out of service mode, and that further notifies the railroad operations control center when the crossing is returned to service.

SUMMARY OF THE INVENTION

This invention is directed to highway-railroad grade crossing warning system, including an approach circuit in the railroad on either side of the highway, an island circuit in the railroad at the intersection of the railroad and the highway, an electronic controller electrically coupled to the approach circuit and to the island circuit, at least one warning device which is activated when a train is detected in the approach circuit or in the island circuit by the electronic controller, and a display in the electronic controller, the display having touch-sensitive fields, at least one touch-sensitive field responsive to the touch of a maintainer to selectively take the approach circuit out of service or to selectively take the island circuit out of service. The warning device may have flashing lights and a gate that may be lowered.

Preferably, the display has a first screen with a first touch-sensitive field for selectively taking the approach circuit out of service and a second touch-sensitive field for selectively taking the island circuit out of service. The display preferably has a third touch-sensitive field for selecting the amount of time that the approach circuit is to remain out of service and/or for selecting the amount of time that the island circuit is to remain out of service. The amount of time that the approach circuit and/or the amount of time that the island circuit remains out of service is selectable in increments of about 1 to 23 hours. The approach circuit and/or the island circuit is automatically restored to service upon expiration of the selected amount of time.

The display may include a second screen with a fourth touch-sensitive field for confirming that the maintainer wishes to take the approach circuit out of service or that the maintainer wishes to take the island circuit remains out of service.

The invention is further directed to methods of taking an approach circuit and/or an island circuit of a highway-railroad grade crossing warning system out of service, including the steps of providing an approach circuit in the railroad on either side of the highway, providing an island circuit in the railroad at the intersection of the railroad and the highway, electrically coupling an electronic controller to the approach circuit and to the island circuit, activating a warning device when a train is detected in the approach circuit or in the island circuit by the electronic controller, and sensing the touch of a maintainer in at least one touch-sensitive field of a display of the electronic controller to selectively take the approach circuit out of service or to selectively take the island circuit out of service.

Additional method steps may include providing a first screen on the display with a first touch-sensitive field for selectively taking the approach circuit out of service, providing a second touch-sensitive field on the first screen of the display for selectively taking the island circuit out of service, providing a third touch-sensitive field on the display for selecting the amount of time that the approach circuit is to remain out of service and/or for selecting the amount of time that the island circuit is to remain out of service, selecting the amount of time that the approach circuit and/or the amount of time that the island circuit remains out of service in increments of about 1 to 23 hours, and touching a fourth touch-sensitive field on the display to confirm that the approach circuit should be taken out of service and/or to confirm that the island circuit should be taken out of service. Service is automatically restored to the approach circuit and/or to the island circuit upon expiration of the selected amount of time.

Yet another aspect of the present invention includes an electronic controller for a highway-railroad grade crossing warning system, the warning system including an approach circuit in the railroad on either side of the highway, an island circuit in the railroad at the intersection of the railroad and the highway, a warning device, the electronic controller including means for coupling to the approach circuit, means for coupling to the island circuit, means for activating the warning device when the controller detects a train in the approach circuit or detects a train in the island circuit, and a display having touch-sensitive fields, at least one touch-sensitive field responsive to the touch of a maintainer to selectively take the approach circuit out of service or to selectively take the island circuit out of service.

Preferably, the display of the controller has a first screen with a first touch-sensitive field for selectively taking the approach circuit out of service and a second touch-sensitive field for selectively taking the island circuit out of service, a third touch-sensitive field for selecting the amount of time that the approach circuit is to remain out of service and/or for selecting the amount of time that the island circuit is to remain out of service. The amount of time that the island circuit remains out of service is selectable in increments of about 1 to 23 hours. Preferably, the display also has a second screen with a fourth touch-sensitive field for confirming that the maintainer wishes to take the approach circuit out of service or that the maintainer wishes to take the island circuit remains out of service. The approach circuit and/or the island circuit is automatically restored to service upon expiration of the selected amount of time.

BRIEF DESCRIPTION OF THE DRAWINGS

The invention, together with its objects and the advantages thereof, may best be understood by reference to the following description taken in conjunction with the accompanying drawings, in which like reference numerals identify like elements in the figures, and in which.

DESCRIPTION OF THE PREFERRED EMBODIMENTS

It will be understood that the invention may be embodied in other specific forms without departing from the spirit thereof. The present examples and embodiments, therefore, are to be considered in all respects as illustrative and not restrictive, and the invention is not to be limited to the details given herein.

Figure 1:
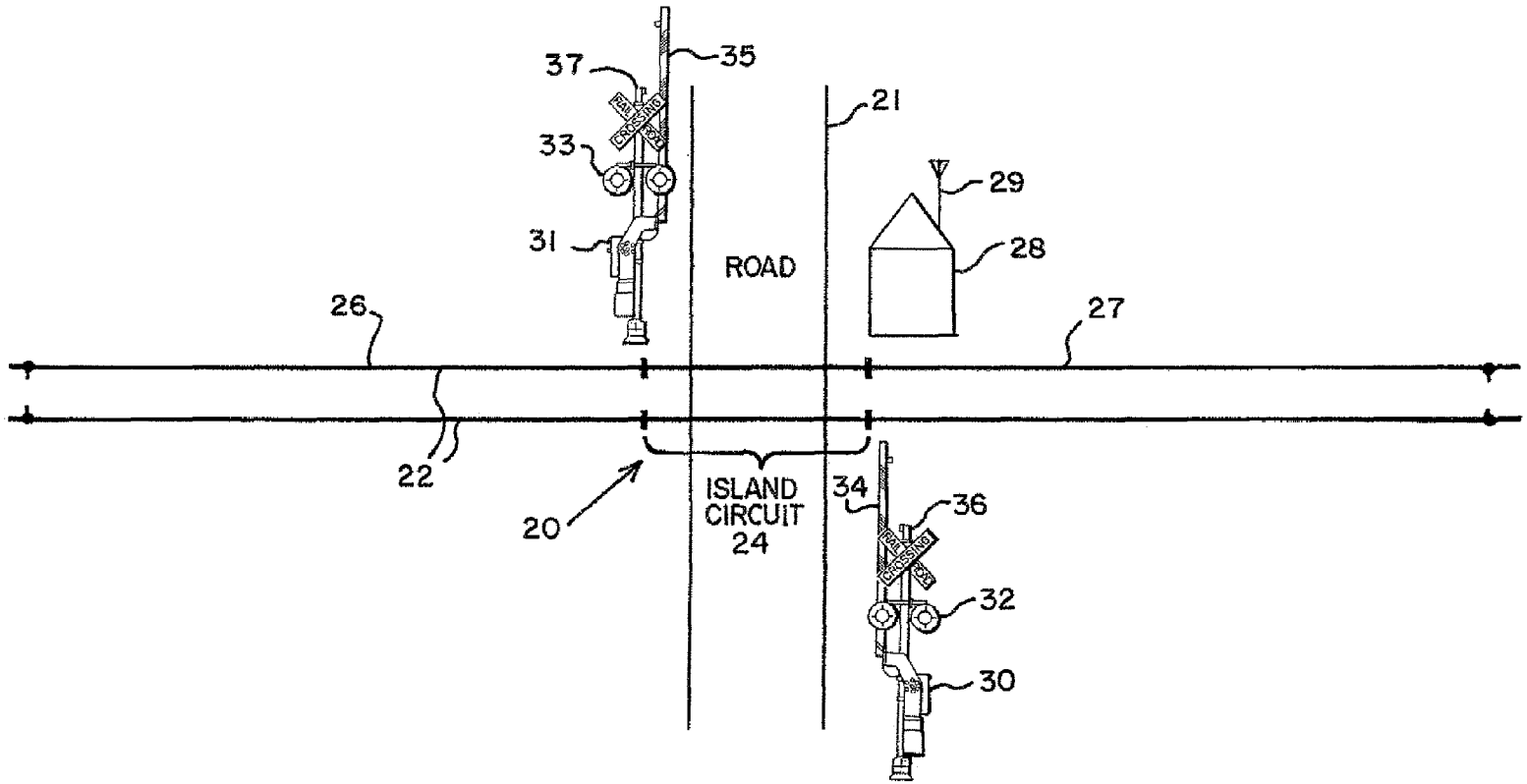
FIG. 1 (PRIOR ART)
FIG. 1 is a diagrammatic illustration of a highway-rail grade crossing including a warning system.
Figure 2:
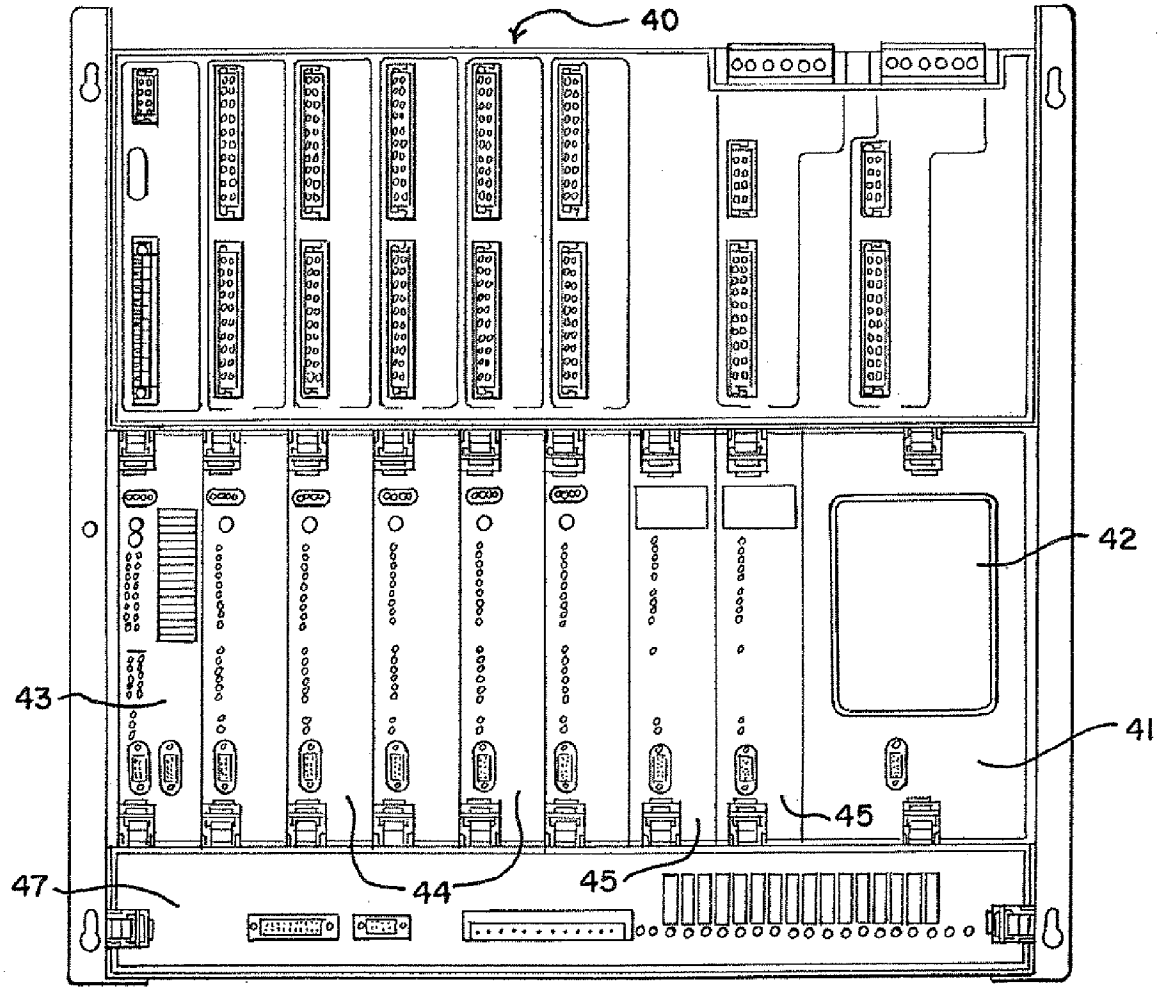
FIG. 2 is an elevational view of a controller in accordance with the present invention for the highway-rail grade crossing of FIG. 1.

With reference to the drawing Figures, FIG. 1 illustrates a highway-rail crossing, generally indicated by reference numeral 20, at a road 21 and a railroad track 22. A Grade Crossing Predictor (GCP) system, generally designated 40 in FIG. 2, is enclosed within a generally weatherproof bungalow or housing 28 (FIG. 1), and in general proximity to at least one railroad track 22. The GCP system 40 will also be hereinafter referred to as a controller or an electronic controller. Preferably, housing 28 is equipped with an antenna 29 to permit reception of signals and to transmit signals, such as to a railroad operations center (not shown).

In a conventional manner, at least that portion of railroad track 22 that intersects with the road 21 is included in an island circuit 24 that is monitored by controller 40. Similarly, those portions of track 22 that lie to the right and to the left of the island circuit 24 are included in an approach circuit are identified by reference numerals 27 and 26, respectively. Approach circuits 26 and 27 are also monitored by the controller 40. Traffic warning devices 30 and 31 are typically placed on both sides of track 22 and adjacent to road 21. Warning devices 30 and 31 are provided with flashing lamps 32 and 33, may be provided with gates 34 and 35 that may be lowered, and may be provided with audible devices, such as bells 36 and 37, or the like, in a known manner. When a train is detected in the approach circuits 26 and 27 or in the island circuit 24, controller 40 activates the flashing lights 32 and 33, activates the audible devices, and, when used, causes the gates 34 and 35 of warning devices 30 and 31 to be lowered.

With reference to FIG. 2, the GCP system or controller 40 is an integrated system that includes all of the control, train detection, and monitoring of a highway-railroad grade crossing warning system, such as for the highway-rail crossing 20 shown in FIG. 1. The railroad grade crossing shown in FIG. 1 may include a plurality of tracks, instead of the single track 22 shown. Likewise, controller 40 may monitor and control a plurality of tracks; for example, typically up to six tracks.

As shown in FIG. 2, controller 40 includes a plurality of modules. One of these modules is a display module 41 with a display 42. Preferably, display 42 is a touch screen display that provides a user interface. For example, the Windows CE® operating system, commercially available from the MicroSoft Corporation of Redmond, Wash., may be employed in controller 40 to provide touch screen display capabilities for display 42 that allow the signal maintainer to program and configure the various parameters. Other modules may include a central processing unit (CPU) 43, track modules 44 for monitoring each track, crossing control modules 45 for controlling the warning devices 30 and 31, an additional CPU module 46 and a recorder module 47 for recording events and conditions at the highway-rail grade crossing 20. As shown in FIG. 2, each of modules 41 and 43-47 may have external connectors, test points and lighted indicators. Since the controller 40 performs the train detection and control circuitry functions internally, the logic outputs and inputs are generally not available to the maintainer.

In accordance with one aspect of the present invention, controller 40 has an out of service function that allows the signal maintainer to take the train detection circuitry 'out of service' on a track, such as track 22, or portion of a track, such as the island circuit 24. Each train detection track circuit consists of an approach circuit 26 and 27 in FIG. 1 and an island circuit 24, also illustrated in FIG. 1. The approach circuit 26 or 27 detects the train in advance of the train occupying the crossing and activates the warning devices 30 and 31 at a predetermined programmable time interval before the occupation. The island circuit 24 detects the presence of the train in the immediate area of the crossing and maintains the device activation.

The controller 40 also controls a maintenance call light (not shown), but typically located to be visible on the exterior of the housing 28 for the controller 40. This maintenance call light is visible to railroad personnel and visually notifies personnel that the crossing control system is its normal state. The maintenance call light is extinguished if the controller 40 senses a malfunction, a loss of commercial power, or a special programmed event, such as a track being taken out of service.

Integrated into controller 40 is a recorder 47 and remote monitoring sub-system that is capable of recording all crossing control and train detection events. Controller 40 also analyzes events and internal states, such as an out of service mode, and transmits messages and alarms to personnel or railroad operations control centers, such as via antenna 29 on housing 28 in FIG. 1. When connected to the appropriate communication device, it can send text messages, send emails, or voice messages to railroad personnel or railroad operations control centers indicating that a crossing has be taken out of service on a given track. Likewise, appropriate personnel or railroad operations control centers can be notified when the crossing is returned to service so that train operations can resume.

Figure 3B:
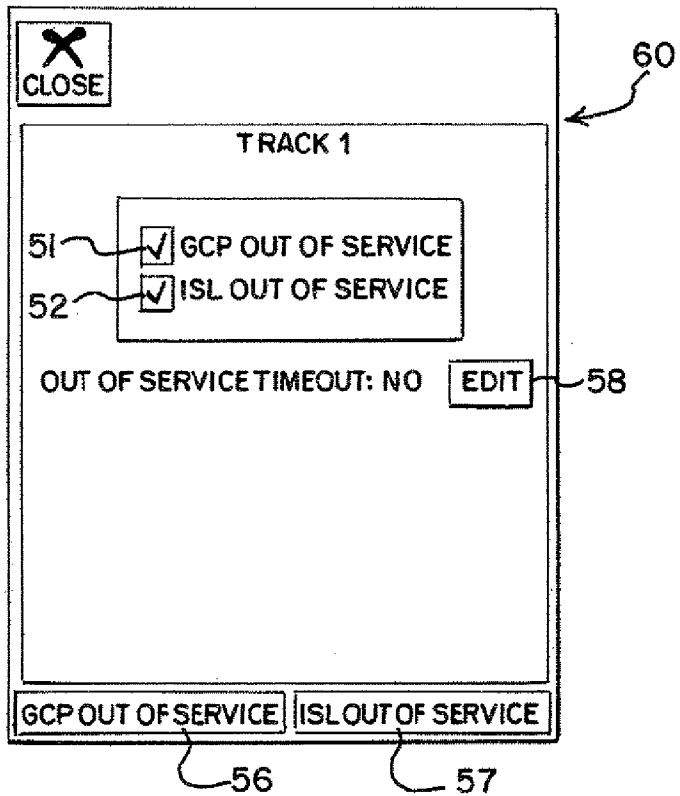
FIGS. 3A and 3B are typical screens that may appear in accordance with the present invention on an interactive screen of the controller of FIG. 2 for initiating an out of service function.
Figure 3A:
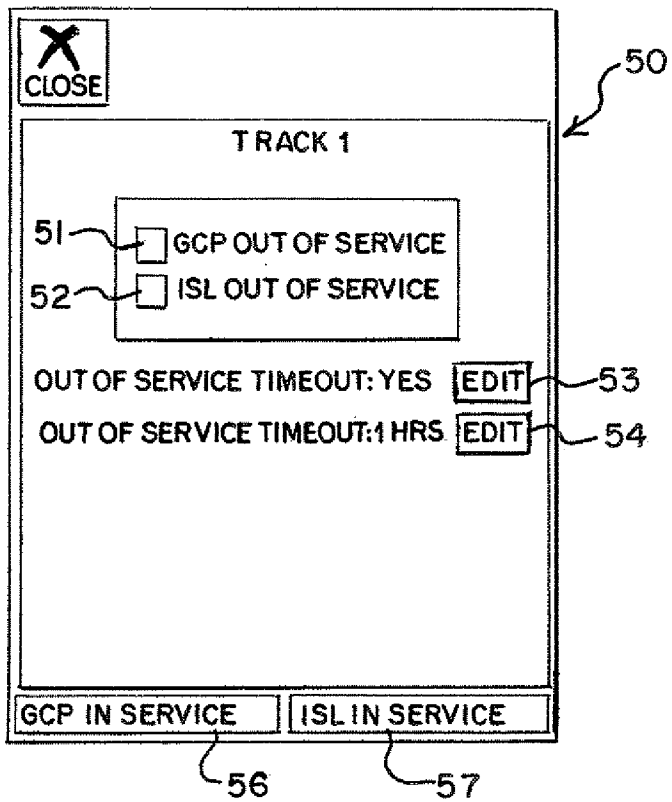

Shown in FIG. 3A is a typical screen, generally designated 50, which appears on the display 42 when an out of service menu is selected. The out of service menu allows the approach circuits 26 and 27 and/or the island circuit 24 of a selected track to be taken out of service for a specified time, which may be an indefinite period or a selected time interval in a range of about 1 to 23 hours. Thus, the approach circuits 26 and 27, the island circuit 24, or both, can be independently taken out of service, as desired.

Screen 50 may have touch-sensitive fields 51 and 52, respectively, for selecting to take the approach circuits 26 and 27 (identified in FIG. 3A as "GCP") out of service or for selecting to take the island circuit 24 (identified in FIG. 3A as "ISL") out of service.

A pair of status fields 56 and 57 in the lower portion of screen 50 will confirm the present status of the approach circuits 26 and 27 and the present status of the island circuit 24. In the example of FIG. 3A, the status fields 56 and 57 indicate that the approach (GCP) circuits and the island (ISL) circuits are both in service since none of the out of service selections have been made in touch-sensitive fields 51 and 52. The track that is affected is shown near the top of the window, which is track 1 in this example. Additional touch-sensitive fields 53 and 54 may be used to select the length of time that the approach circuit 26 and 27 and/or the island circuit 24 will remain out of service. For example, touching field 54 will set the out of service time to a default value of one hour. Use of touch-sensitive field 53 may edit the out of service time up to about 23 hours.

In the example of FIG. 3B, a typical screen, generally designated 60, the check marks in both touch-sensitive fields 51 and 52 indicate that a maintainer has selected to take both the approach circuits 26 and 27 and the island circuit 24 out of service. These selections are also confirmed by the status fields 56 and 57, which now indicate that the approach (GCP) circuits and the island (ISL) circuit are out of service. Screen 60 also indicates that an out of service timeout has not been selected and the maintainer is invited to touch a field 58 to enter the desired length of the time that the selected circuits should remain out of service.

Figure 4A:
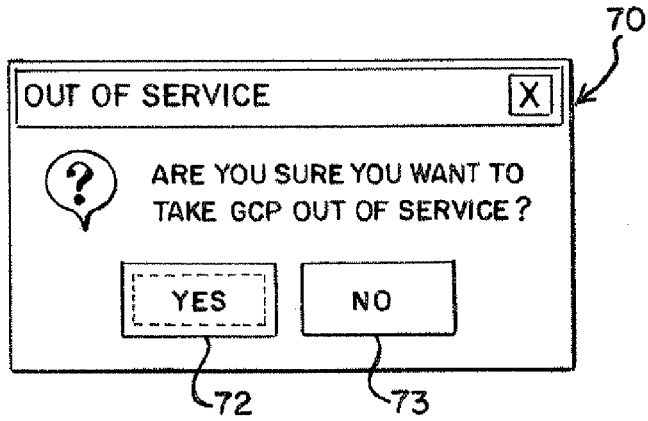
FIGS. 4A and 4B are typical screens that may appear in accordance with the present invention on the interactive screen of the controller of FIG. 2 when an out of service function is initiated on one of the screens of FIG. 3A or 3B.
Figure 4B:
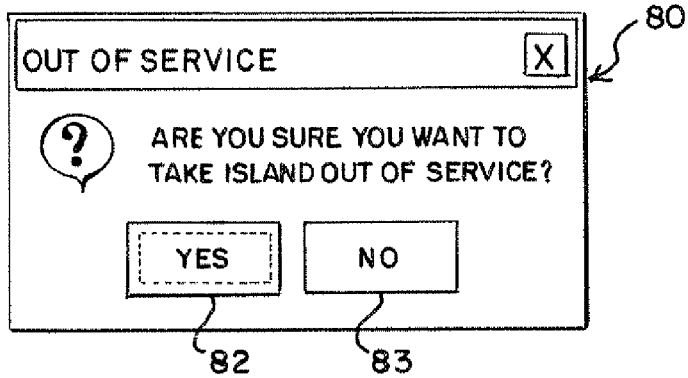

Preferably, the selection of taking the approach circuits 26 and 27 and/or the island circuit 24 out of service, as by touching fields 51 and/or 52 in FIGS. 3A or 3B will cause another screen 70 and/or 80 to appear on the display 42, such as shown in FIGS. 4A and 4B. For example, when touch-sensitive field 51 in FIG. 3A is touched, screen 70 will appear to confirm that the maintainer wishes to take the approach circuits out of service. Pressing the "Yes" box 72 in FIG. 4A will cause a check mark to be placed in touch-sensitive field 51, thereby taking the approach circuits out of service. Touching of the "No" box 73 in FIG. 4A will cancel the prior selection of taking the approach circuits out of service.

Similarly, when touch-sensitive field 52 in FIG. 3A is touched, screen 80 will appear to confirm that the maintainer wishes to take the island circuit out of service. Pressing the Yes box 82 in FIG. 4B will cause a check mark to be placed in touch-sensitive field 52, thereby taking the island circuit out of service. Touching of the No box 83 in FIG. 4B will cancel the prior selection of taking the island circuit out of service. The interactive dialog with the maintainer that is provided by screens 70 and 80 thus helps minimize human error in inadvertently or erroneously taking the approach or island circuits out of service.

The amount of time that the selected track and the selected approach and/or island circuits remain out of service are selected by the touch-sensitive Edit fields 53 and 54 in FIG. 3A. Touching of Edit field 53 can select whether a timeout is desired. If no timeout is desired, a legend that no timeout has been selected will appear, as in FIG. 4B. However, if the maintainer wishes to select a timeout period, touching of the Edit field 58 in FIG. 3B will again provide the option of selecting a timeout interval. If the out of service mode is to be timed out, touching of an Edit field 54 in FIG. 3A will permit the maintainer to enter the desired length of the timeout, which may generally be in the range of one to 23 hours. If no selection is made for the length of the timeout, a default period of one hour will be in effect. The length of the selected timeout will be displayed the display 42, such as 1 hour in the example of FIG. 3A.

When the desired work on the selected track is completed, the approach and/or island circuits can be placed back in service by touching of the appropriate fields 51 and/or 52 in FIG. 3B. However, if the maintainer fails to manually place the appropriate circuits back in service with fields 51 and/or 52, the system is returned to service after expiration of the selected timeout interval, thereby further minimizing human error.

Figure 5:
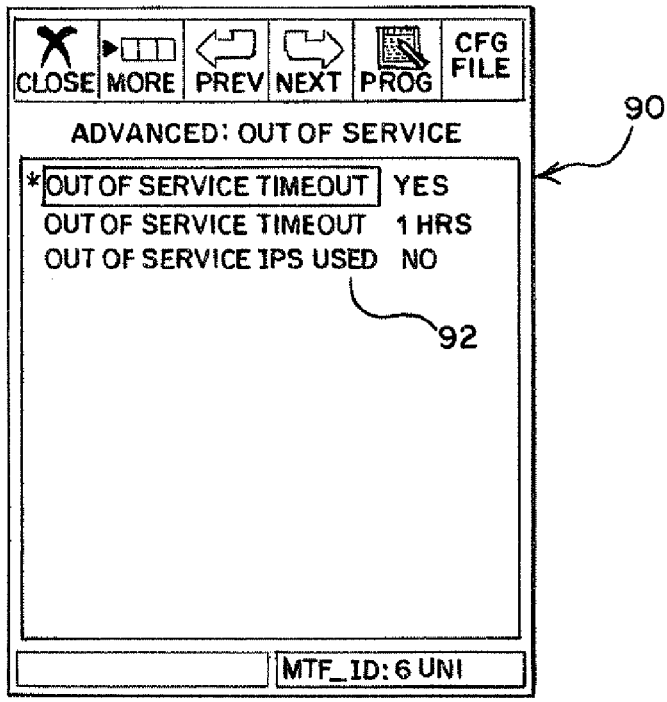
FIG. 5 is a typical screen that may appear in accordance with the present invention to determine the length of time that one or more tracks will remain out of service, including a minimum or default time.

The out of service function can require that an input is also connected to 12 volts before taking a track out of service. This feature requires that the maintainer also take physical action as well as the afore-described touch-screen actions and confirmation. To this end, a further screen 90 in FIG. 5 may be used. An out of service inputs used entry 92 determines how a track may be taken out of service. When set to No, as shown in FIG. 5, a track may be taken out of service by using only the display 42 and the associated screens of FIGS. 3A-4B. However, when set to Yes, each track to be taken out of service is assigned an input and then strapped high (energized) before the display 42 may be used to take the track out of service.

While data entry in the above-described embodiments is by means of a touch sensitive screen on display 42, it will be appreciated by those skilled in the art that other means of data entry may also be utilized. For example, a hand-held or laptop computer may be in communication with the electronic controller 40 via antenna 29. Similarly, other types of communication devices, keyboards, and the like, may communicate with controller 40 for stepping through the programming steps.

While particular embodiments of the invention have been shown and described, it will be obvious to those skilled in the art that changes and modifications may be made therein without departing from the invention in its broader aspects.

The invention claimed is:

1. A highway-railroad grade crossing warning system, said warning system comprising:

an approach circuit in the railroad on either side of the highway;

an island circuit in the railroad at the intersection of the railroad and the highway;

an electronic controller electrically coupled to said approach circuit and to said island circuit;

a warning device which is activated when a train is detected in the approach circuit or in the island circuit by the electronic controller;

a display in the electronic controller, the display having a plurality of touch-sensitive fields, a first touch-sensitive field on the display in said electronic controller responsive to a command for selectively taking the approach circuit out of service;

a second touch-sensitive field on the display in said electronic controller responsive to a command for selectively taking the island circuit out of service;

a third touch-sensitive field on the display in said electronic controller for selecting the amount of time that the approach circuit or the island circuit is to remain out of service, and means in said electronic controller for restoring service to said approach circuit or to said island circuit upon expiration of the entered amount of time.

2. The highway-railroad grade crossing warning system of claim 1, wherein the amount of time that the approach circuit and/or the amount of time that the island circuit remains out of service is selectable in increments of 1 to 23 hours.

3. The highway-railroad grade crossing warning system of claim 1, wherein the display has a first screen for displaying the first three touch-sensitive fields, and the display has a second screen with a fourth touch-sensitive field for confirming that the maintainer wishes to take the approach circuit out of service or that the maintainer wishes to take the island circuit out of service.

4. A method of taking an approach circuit and/or an island circuit of a highway-railroad grade crossing warning system out of service with an electronic controller for electrically coupling to the approach circuit and to the island circuit, said method comprising the steps of:

providing a means for coupling the electronic controller to the approach circuit;

providing a means for coupling the electronic controller to the island circuit;

providing a means for activating a warning device when the controller detects a train in the approach circuit or detects a train in the island circuit;

providing a display in the electronic controller;

providing a plurality of touch-sensitive fields on the display;

touching a first touch-sensitive field on the display to selectively take the approach circuit out of service;

touching a second touch-sensitive field on the display to selectively take the island circuit out of service;

using a third touch-sensitive field on the display to enter an amount of time that the approach circuit or the island circuit is to remain out of service; and restoring service to said approach circuit or to said island circuit upon expiration of the selected amount of time.

5. The method of taking an approach circuit and/or an island circuit of a highway-railroad grade crossing warning system out of service in accordance with claim 4 said method further comprising the step of:

selecting the amount of time that the approach circuit and/or the amount of time that the island circuit remains out of service in increments of 1 to 23 hours.

6. The method of taking an approach circuit and/or an island circuit of a highway-railroad grade crossing warning system out of service in accordance with claim 4, said method further comprising the step of:

touching a fourth touch-sensitive field on the display to confirm that the approach circuit should be taken out of service and/or to confirm that the island circuit should be taken out of service.

7. An electronic controller for a highway-railroad grade crossing warning system, said warning system including an approach circuit in the railroad on either side of the highway, an island circuit in the railroad at the intersection of the railroad and the highway, at least one gate which is normally raised and a plurality of warning lights; said electronic controller comprising:

means for coupling the electronic controller to the approach circuit;

means for coupling the electronic controller to the island circuit;

means for activating a warning device when the controller detects a train in the approach circuit or detects a train in the island circuit;

a display in the electronic controller, the display having a plurality of touch-sensitive fields, a first touch-sensitive field on the display in said electronic controller responsive to a command for selectively taking the approach circuit out of service;

a second touch-sensitive field on the display in said electronic controller responsive to a command for selectively taking the island circuit out of service;

a third touch-sensitive field on the display in said electronic controller for selecting the amount of time that the approach circuit or the island circuit is to remain out of service, and means in said electronic controller for restoring service to said approach circuit or to said island circuit upon expiration of the entered amount of time.

8. The electronic controller in accordance with of claim 7, wherein the amount of time that the approach circuit and/or the amount of time that the island circuit remains out of service is selectable in increments of 1 to 23 hours.

9. The electronic controller in accordance with claim 7, wherein the display has a first screen for displaying the first three touch-sensitive fields, and the display has a second screen with a fourth touch-sensitive field for confirming that the maintainer wishes to take the approach circuit out of service or that the maintainer wishes to take the island circuit remains out of service.

* * * * *